US011261832B2

(12) United States Patent
Van Keulen

(10) Patent No.: US 11,261,832 B2
(45) Date of Patent: Mar. 1, 2022

(54) ENGINE AIR FLOW ESTIMATION

(71) Applicant: DAF Trucks N.V., Eindhoven (NL)

(72) Inventor: Thijs Adriaan Cornelis Van Keulen, Eindhoven (NL)

(73) Assignee: DAF Trucks N.V., Eindhoven (NL)

( * ) Notice: Subject to any disclaimer, the term of this patent is extended or adjusted under 35 U.S.C. 154(b) by 19 days.

(21) Appl. No.: 16/970,050

(22) PCT Filed: Feb. 15, 2019

(86) PCT No.: PCT/NL2019/050100

§ 371 (c)(1),
(2) Date: Aug. 14, 2020

(87) PCT Pub. No.: WO2019/160415

PCT Pub. Date: Aug. 22, 2019

(65) Prior Publication Data

US 2021/0088013 A1 Mar. 25, 2021

(30) Foreign Application Priority Data

Feb. 16, 2018 (NL) ..... 2020448

(51) Int. Cl.
*F02M 35/10* (2006.01)
*F01N 3/20* (2006.01)
(Continued)

(52) U.S. Cl.
CPC ..... *F02M 35/10157* (2013.01); *F01N 3/2066* (2013.01); *F02M 31/20* (2013.01);
(Continued)

(58) Field of Classification Search
CPC ..... F02M 35/10157; F02M 31/20; F02M 35/024; F02M 35/1038; F01N 3/2066;
(Continued)

(56) References Cited

U.S. PATENT DOCUMENTS 9,689,335 B2 * 6/2017 Ge ..... F02D 41/0007
2016/0312728 A1 10/2016 Ge

FOREIGN PATENT DOCUMENTS

EP 1662127 A2 5/2006

OTHER PUBLICATIONS

Lino Guzzella et al., "Introduction to Modeling and Control of Internal Combustion Engine Systems," Jan. 2010, Berlin Heidelberg, URL: http://www.powerslyle.ru/docs/ebook.pdf, pp. 40-47.

(Continued)

*Primary Examiner* — Brandon D Lee
(74) *Attorney, Agent, or Firm* — Banner & Witcoff, Ltd.

(57) ABSTRACT

According to the invention, a method and system for estimating fresh air flow into a turbocharged engine (105) is provided. A controller (109) arranged to determine an actual fresh air mass flow in subsequent time frames by measuring, in an actual time frame, a pressure drop over a compressor (101) and using a first calculated fresh air mass flow as a starting value for deriving a second fresh air mass flow in said time frame from a compressor model using the measured pressure drop and a compressor rotational speed. In a previous time frame, before said actual time frame, a pressure drop is measured over an air treatment device. A pressure drop is estimated over the air treatment device (103, 104, 106, 108) using the second fresh air mass flow and an estimated flow resistance of the air treatment device. Subsequently, the second fresh air mass flow is corrected by comparing the estimated pressure drop with the measured pressure drop over the air treatment device and using the corrected second fresh air mass flow as an actual fresh air mass flow in said time frame.

8 Claims, 6 Drawing Sheets

(51) Int. Cl.
*F02M 31/20* (2006.01)
*F02M 35/024* (2006.01)

(52) U.S. Cl.
CPC ..... *F02M 35/024* (2013.01); *F02M 35/1038* (2013.01); *F01N 2610/02* (2013.01); *F01N 2610/1453* (2013.01)

(58) Field of Classification Search
CPC ..... F01N 2610/02; F01N 2610/1453; F02D 2200/0402; F02D 2200/0406; F02D 41/18; F02D 41/0007
See application file for complete search history.

(56) References Cited

OTHER PUBLICATIONS

Oct. 7, 2019, International Search Report and Written Opinion, PCT/NL2019/050100.

* cited by examiner

ENGINE AIR FLOW ESTIMATION

CROSS-REFERENCE TO RELATED APPLICATIONS

This application is a U.S. National Stage application under 35 U.S.C. § 371 of International Application PCT/NL2019/050100 (published as WO 2019/160415 A1), filed Feb. 15, 2019, which claims the benefit of priority to Application NL 2020448, filed Feb. 16, 2018. Benefit of the filing date of these prior applications is hereby claimed. Each of these prior applications is hereby incorporated by reference in its entirety.

The invention relates to the estimation of mass air flow in a turbocharged diesel engine, optionally equipped with high-pressure exhaust gas recirculation (EGR).

Fresh air mass flow measurement or estimation can be an important signal for, e.g., urea dosing accuracy in diesel engine aftertreatment systems; robustness of tailpipe emission control; NOx estimation for NOx sensor diagnostics; transient torque response functionality; torque estimation; robustness of calibration; and/or engine-out emission control. Fresh air flow can be determined by estimation or measurement. However, estimation of mass flow is currently limited by accuracy, and/or robustness to disturbances. While direct measurement of flow is limited by measurement bandwidth and requires an additional sensor. For example, air flow is estimated using a measurement of the oxygen content in the exhaust. However, an oxygen sensor typically has delay that hinders immediate feedback of the estimated air flow, so that this signal cannot be used adequately in real time.

Accordingly it is an object of the present invention to propose a method for estimating fresh air flow into a compressor of a turbocharged diesel engine. In a more general sense it is thus an object of the invention to overcome or reduce at least one of the disadvantages of the prior art. It is also an object of the present invention to provide alternative solutions which are less cumbersome in assembly and operation and which moreover can be made relatively inexpensively. Alternatively it is an object of the invention to at least provide a useful alternative. The objectives include a novel air mass flow estimator that combines system knowledge with available air path sensors, possibly without EGR mass flow input.

According to the invention, a method and system for estimating fresh air flow into a turbocharged engine is provided. A controller is arranged to determine an actual fresh air mass flow in subsequent time frames by measuring, in an actual time frame, a pressure drop over a compressor and using a first calculated fresh air mass flow as a starting value for deriving a second fresh air mass flow in said time frame from a compressor model using the measured pressure drop and a compressor rotational speed. In a previous time frame, before said actual time frame, a pressure drop is measured over an air treatment device. A pressure drop is estimated over the air treatment device using the second fresh air mass flow and an estimated flow resistance of the air treatment device and the second fresh air mass flow is corrected by comparing the estimated pressure drop with the measured pressure drop over the air treatment device and using the corrected second fresh air mass flow as an actual fresh air mass flow in said time frame.

The invention has as an advantage, that by this method an air flow can be measured in real time in an accurate and reliable way. The invention may be further advantageous by reducing the system cost by avoiding the need for a mass flow sensor and by improving the accuracy of the air flow estimates. Aiming at a fast detection of changes in mass flow not hindered by the measurement delay of individual sensors while being robust to uncertainty in the description of the components, and to uncertainty due to wear, fouling, and ambient conditions.

By using the compressor model and fast read outs of pressure values, the air flow can be estimated accurately, so that, inter alia, an efficient and timely control of an EGR device can be realized.

The invention will further be elucidated by description of some specific embodiments thereof, making reference to the attached drawings. The detailed description provides examples of possible implementations of the invention, but is not to be regarded as describing the only embodiments falling under the scope. The scope of the invention is defined in the claims, and the description is to be regarded as illustrative without being restrictive on the invention. In the drawings:

FIG. 1 schematically shows a schematic setup of an exemplary system comprising a turbocharged engine;

Figure 1:
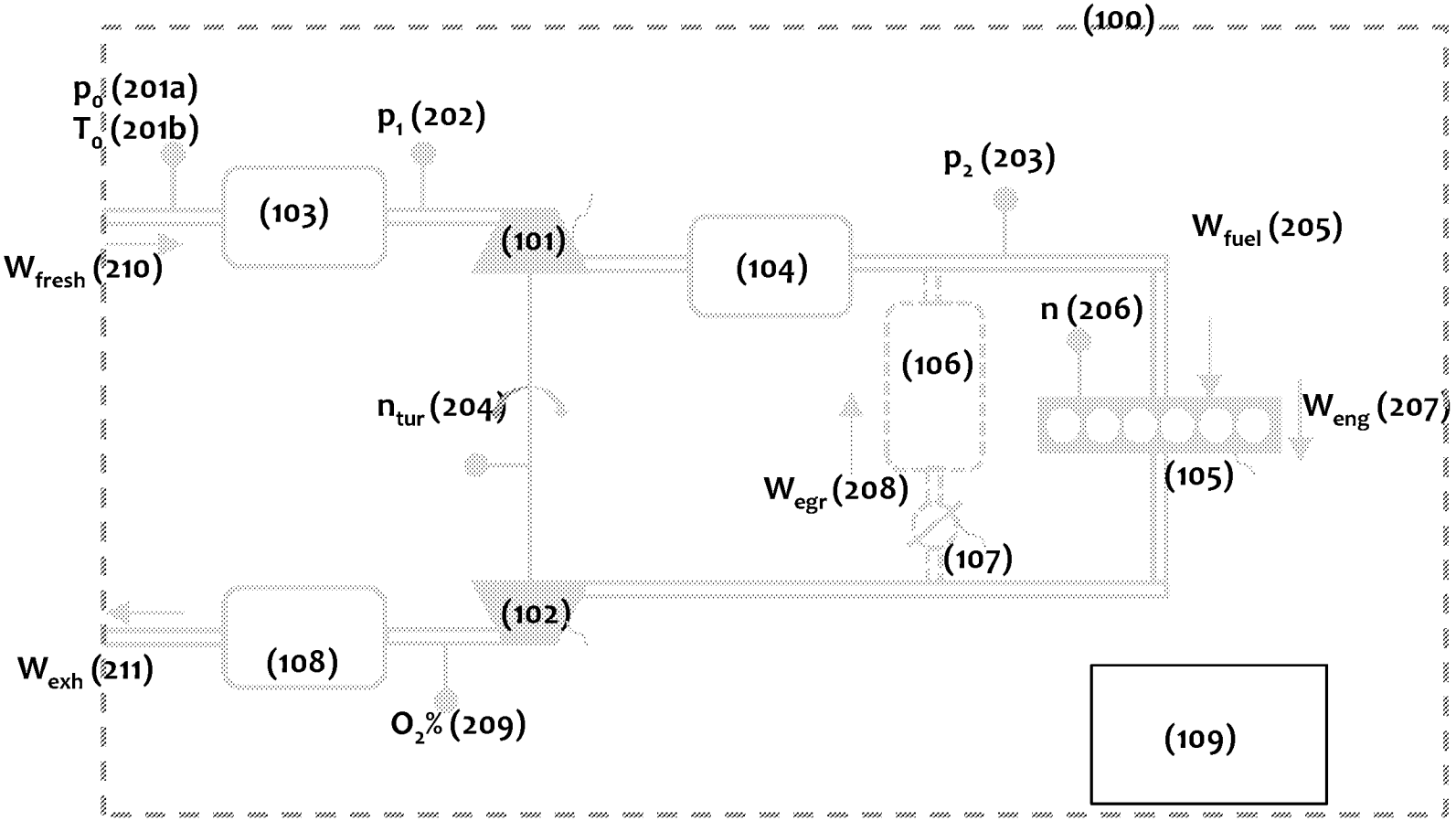

In FIG. 1 a schematic overview of the system 100 layout is depicted. The objective is to provide an accurate estimate of the fresh air mass flow $W_{fresh}$ 210, i.e. the mass flow of fresh air into the engine system 100, and possibly the EGR mass flow $W_{egr}$ 208 if present.

In the system layout, a compressor 101 is located in an inlet flow path of the engine. The compressor 101 may be propelled by a turbine 102, that may be mechanically coupled. In another form, multistage turbochargers are envisioned. A compressor rotational speed sensor $n_{tur}$ 204 may be provided. In another form, the turbine could include an actuator which can be used to optimize the turbocharger performance at different operating conditions, e.g., a Variable Geometry Turbine VGT or a Variable Nozzle Turbine VNT. In yet another form, compressor and turbine assemblies which are not only mechanically coupled are envisioned, for example an electric assisted turbocharger also known as e-turbo. Further, a pressure sensor 202 is provided in an inlet of the compressor 101. A further pressure sensor 203 is located downstream the compressor 101, able to measure a pressure in the intake manifold of the engine. Due to the compression of the intake air, the temperature of the air will increase. Hence, often downstream the compressor 101 a so called charge air cooler 104 is used.

The pressure sensor 203 may be provided before or after the cooler 104.

Further, an air treatment device located in the flow path of the engine has pressure sensors in an inlet of the air treatment device and a pressure sensor in an outlet of the air treatment device.

In one form, the air treatment is an air filter 103, for example upstream of the compressor 101. In the embodiment shown, an ambient pressure sensor $p_0$ 201*a* and a pre-compressor pressure sensor $p_1$ 202 is included, so that a pressure drop over the air treatment device can be measured. In another form, the pressure difference between pre-compressor pressure and ambient pressure is measured.

In one form, the engine 105 is a six cylinder four-stroke internal combustion engine. Estimation of the injected fuel mass flow $W_{fuel}$ 205 may be available. The mass flow through the cylinders $W_{eng}$ 207 may be available using a speed density method known per se. For example, this may be derived from an engine speed sensor n 206 for measuring engine speed N and the volumetric efficiency is defined as the flow intake relative to the rate at which volume is displaced by the piston, i.e., for a four stroke engine, see given by:

$$\eta_{vol} = \frac{2W_{Eng}}{\rho_{air} V_d n_{cyl} N} \quad \text{Eq. 1}$$

In Eq. 10, $W_{eng}$ is the air mass flow into the cylinders, $\rho_{air}$ is the air density of the intake air, $V_d$ is the displacement volume, $n_{cyl}$ the number of cylinders and N the engine speed.

The volumetric efficiency can be described as a function of, e.g., intake manifold pressure $p_{im}$ and temperature $T_{im}$ and engine speed and implemented using, e.g., a look-up table. Hence, the air mass flow passing the inlet valves can be computed by:

$$W_{Eng} = \eta_{vol}(N, p_{im}, T_{im}, \ldots)\frac{\rho_{air} V_d n_{cyl} N}{2} \quad \text{Eq. 2}$$

Here, the air density of the intake air can be computed using the ideal gas law:

$$\rho_{air} = \frac{p_{im}}{RT_{im}} \quad \text{Eq. 3}$$

In which R is the gas constant.

In another form, the engine has a different number of cylinders or a different number of operating cycles. Furthermore, to reduce the engine out NOx mass flow to legal limits, the engine system could be equipped with an after-treatment system 108 which could include a particle filter and a catalyst.

In other embodiments, a measured pressure drop over the charge air cooler 104, EGR cooler 106 or after-treatment system 108, or another restriction in the air path of the engine can replace the air filter 103 in the above scheme. Further to FIG. 1, while the method may be applied to any flow measurement including a compressor 101, a turbo-charged engine 105 and a further treatment device, such as an air filter 103, cooler 104 or after treatment device 108 etc, in certain embodiments, an exhaust gas recirculation device (EGR) may be used to reduce the formation of Nitrogen Oxides NOx during the combustion by recirculating part of the exhaust gas from the exhaust manifold to the intake manifold.

The recirculated exhaust gas may be cooled in an EGR cooler 106 and an EGR valve 107 might be employed to regulate the recirculated mass flow $W_{egr}$ 208. The flow $W_{egr}$ 208 can be estimated as the difference between the fresh air flow $W_{fresh}$ 210 and the estimated engine air flow $W_{eng}$ 207 using a speed density method.

In the system 100 a controller 109 is arranged to determine an actual fresh air mass flow. The controller may be arranged in hardware, software or combinations and may be a single processor or comprise a distributed computing system. Typically, a controller operates in time units such as (numbers of) clock cycles that define a smallest time frame wherein data can be combined by logical operations. Depending on various implementations, the aim is to provide an actual estimation of the fresh air flow, for actual control of subsequent devices, e.g. the fuel injection 205, the EGR valve 107 or urea doser in after treatment system 108. As can be derived from FIG. 2, according to the invention the fresh air flow is provided by an iterative process, in subsequent time frames by measuring (S100), in an actual time frame, a pressure drop over the compressor and using a first calculated fresh air mass flow as a starting value for deriving a second fresh air mass flow (S200) in said time frame from a compressor model using the measured pressure drop and a compressor rotational speed;

measuring in a previous time frame (S900), before said actual time frame, a pressure drop over the air treatment device; and correcting the second fresh air mass flow (S300) by comparing the estimated pressure drop with the measured pressure drop over the air treatment device and using the corrected second fresh air mass flow as an actual fresh air mass flow in said time frame.

Figure 3:
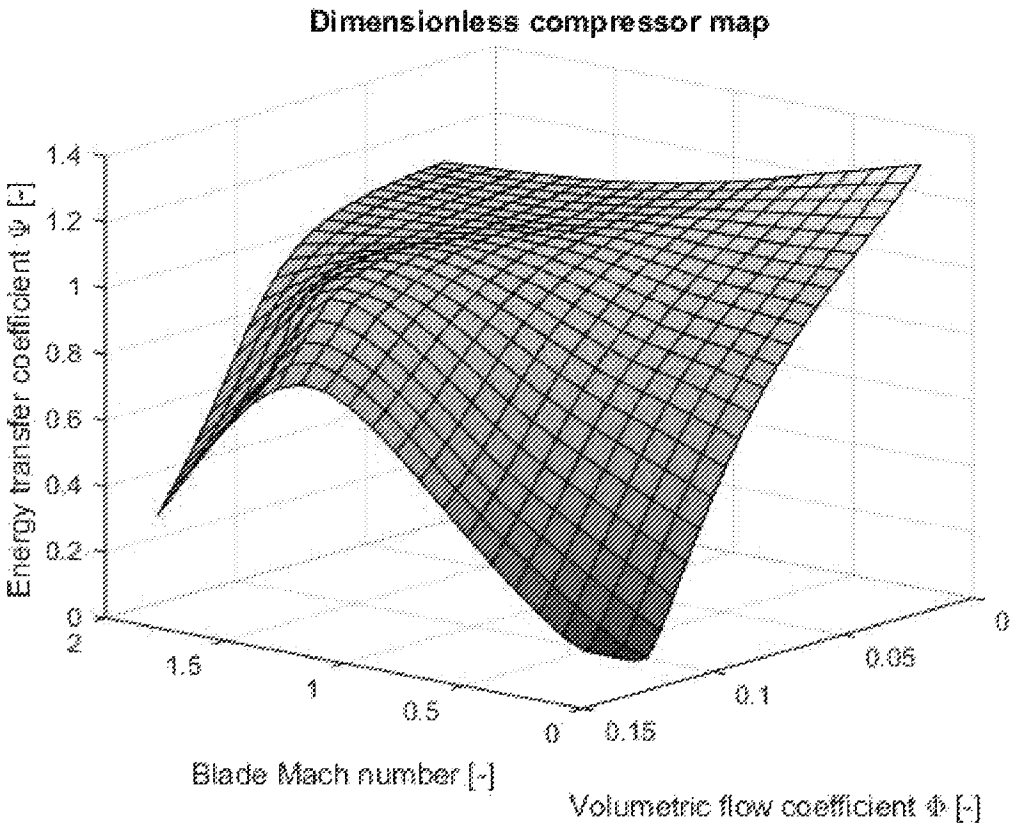
FIG. 3 shows a sample graph of a filter characteristic.

In a more detailed form, FIG. 3 offers a dimensionless compressor map, wherein three dimensionless quantities are combined.

The first dimensionless number that is used, is the normalized air mass flow (which is a form of the reciprocal Reynolds number) defined as follows:

$$\Phi = \frac{W_{fresh}}{n_{tur} \cdot \pi \cdot r_c^3 \cdot \rho_{humid}} \quad \text{Eq. 4}$$

Here, $W_{fresh}$ (210) is the mass flow through the compressor, $n_{tur}$ (204) is the compressor rotational speed, $r_c$ is the outer radius of the compressor wheel, and $\rho_{humid}$ the air density of humid air before the compressor, calculated as a mixture of ideal gases.

$$\rho_{humid} = \frac{(p_1 - p_{a_dew})M_d + p_{a_dew}M_v}{R_u \cdot T_0} \quad \text{Eq. 5}$$

Here, $p_1$ (202) is the absolute pressure of the gas at the compressor intake, $R_u$ is the universal gas constant, and $T_0$ (201*b*) is the absolute temperature, $M_d$ the molar mass of dry air, $M_v$ the molar mass of water vapor, and the $p_{a\text{-}dew}$ the vapor pressure of water (dew point).

The second dimensionless number is the energy transfer coefficient which includes the absolute pressure build up ratio $\hat{\Pi}$ over the compressor:

$$\Psi = \frac{2c_{p_air} \cdot T_0 \cdot \left(\hat{\prod}^{\frac{\kappa-1}{\kappa}} - 1\right)}{n_{tur}^2 \cdot r_c^2} \quad \text{Eq. 6}$$

Here, $c_{p_air}$ is the specific heat capacity of air and κ is a gas constant given by $$\kappa = \frac{c_{p_air}}{c_{p_air} - R_{gas}} \quad \text{Eq. 7}$$

Here $R_{gas}$ is the gas constant for fresh air.

The third dimensionless number is the blade Mach number:

$$Ma = \frac{n_{tur} \cdot r_e}{\sqrt{\kappa \cdot R_{gas} \cdot T_0}} \quad \text{Eq. 8}$$

Figure 2:
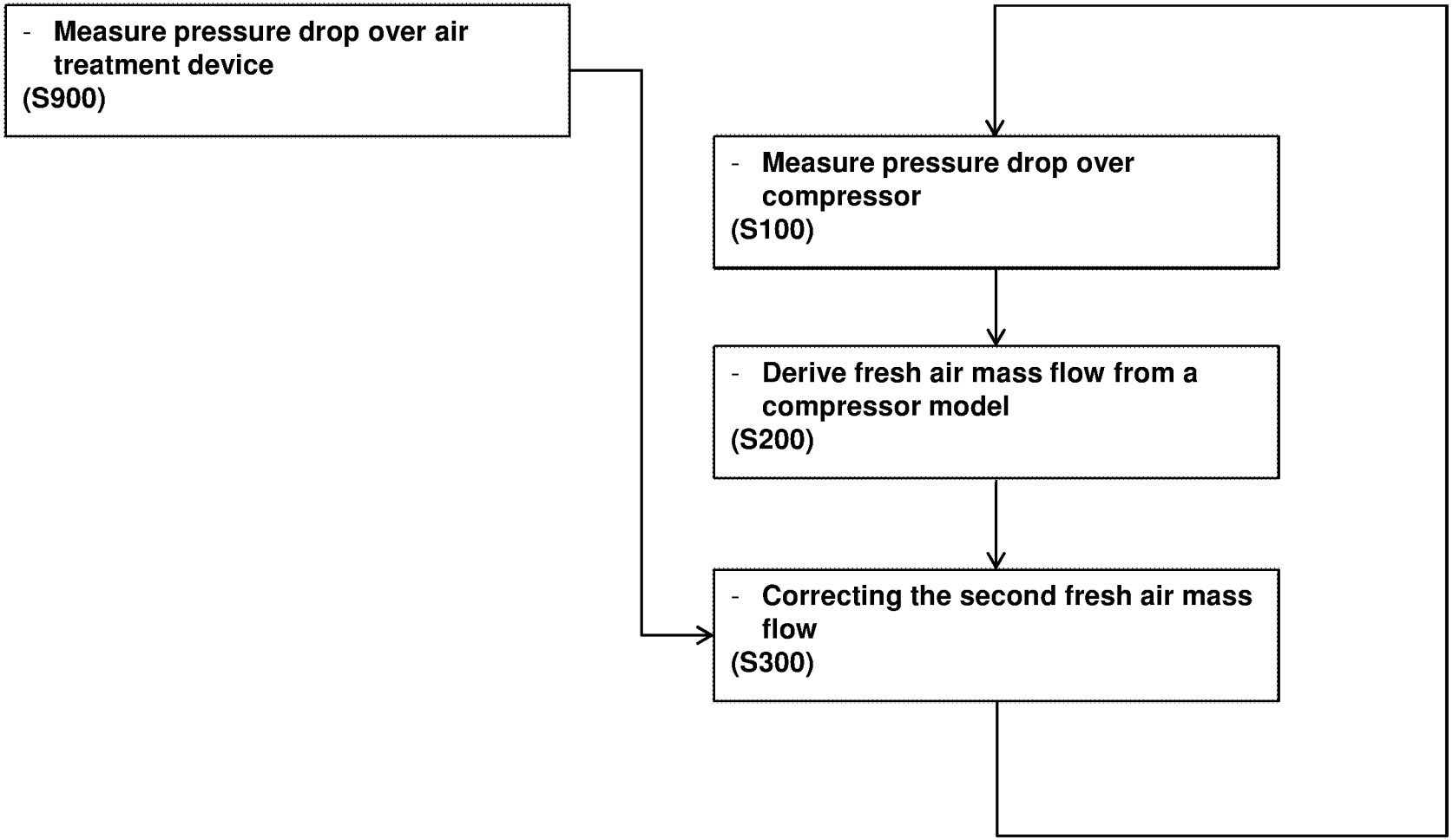
FIG. 2 shows a sample graph of a compressor map.

As illustrated by FIG. 2, from the compressor model map, the energy transfer coefficient can be described as a function of the blade Mach number Ma and the flow coefficient $\phi$. Hence, Eq. (3) can be solved for a compressor pressure build up ratio:

$$\hat{\prod} = \left(\frac{n_{tur}^2 \cdot r_c^2 \cdot \Psi(\phi, Ma)}{2c_p \cdot T_{in}} + 1\right)^{\frac{\kappa-1}{\kappa}} \quad \text{Eq. 9}$$

From the normalized mass flow, the energy transfer coefficient and the Mach number, the build up ratio $\hat{\Pi}$ over the compressor can be determined.

In the compressor model, this build up ration may be a function of mass flow, since the mass of the gas captured in the compressor and surrounding tubes experiences a force by the pressure difference generated by the compressor 101 (as displayed in FIG. 1). As a non limiting example a model by Moore-Greitzer introduces a compressor mass flow state. A time resolved model, assumes that the density changes slower that the mass flow, which gives the following differential equation for the mass flow in the compressor.

$$\frac{dW_{fresh}}{dt} = \frac{\pi r_c}{\tau_c L_c}\left(\hat{\prod} p_1 - p_{out}\right) \quad \text{Eq. 10}$$

Here $L_c$ is the compressor out duct length (tuning variable), $\hat{\Pi}$ is the pressure ratio that is imposed by the compressor on the gas, $p_1$ (202) might be given by (Eq. 12), and $p_{out}$ is the pressure downstream the compressor, given by $$p_{out} = p_2 - \Delta p_{cac} \quad \text{Eq. 11}$$

Here, p2 (203) is the pressure measured in the intake manifold, and $\Delta p_{cac}$ is an estimated pressure drop over the charge air cooler (104). The dynamics of compressor rotational speed and pressure are assumed to be fast compared to the dynamics associated with compressor flow.

The mass flow through some engine components, e.g., mass flow through the compressor, turbine, and/or cylinders is influenced by component characteristics that remain constant over lifetime. Yet estimation of mass flow based on a model of these components has limited accuracy due to uncertainty in the modeling, i.e. due to the complexity of the underlying relation. To improve this, the invention proposes to use other components in the engine air path, e.g., an air filter, EGR cooler or after treatment system in addition, that have a more unambiguous relation between mass flow and pressure drop. Hence, by measuring this pressure drop, a fast estimation of the mass flow can be obtained. However, this estimation is generally uncertain due to changes in the characteristics of the component itself, e.g., caused by wear or fouling. So, estimation based on a model of these components has limited accuracy due to uncertainty in the modeling due to changes in the flow resistance of the component.

Figure 4:
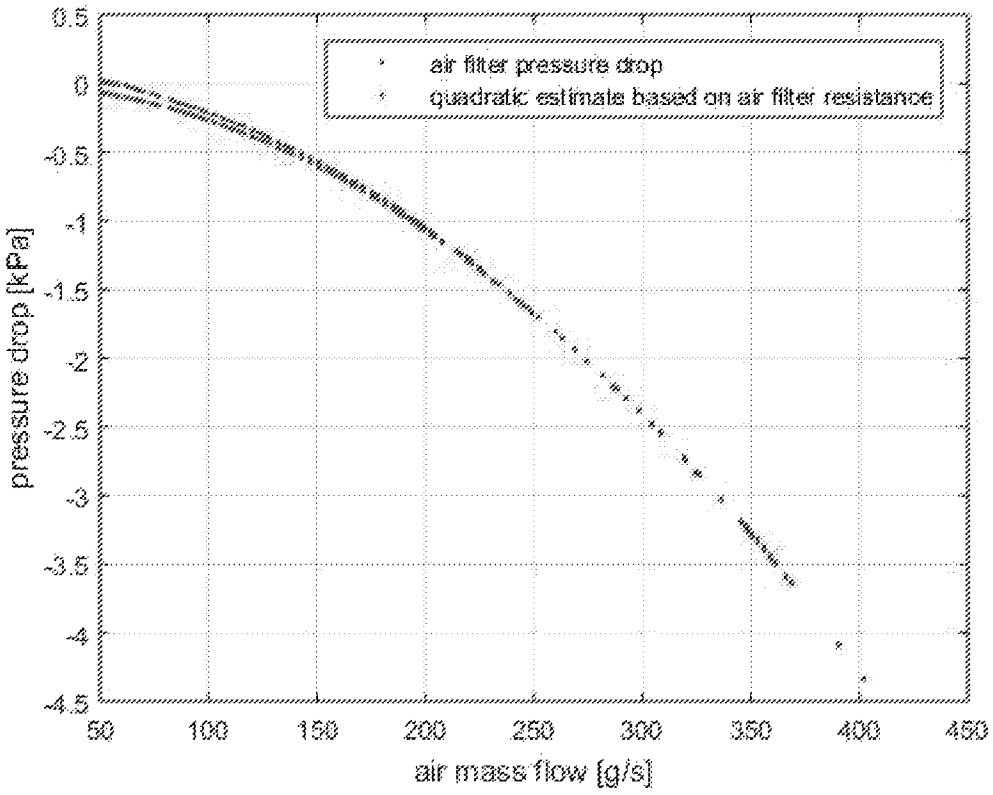
FIG. 4 shows a comparison of the estimation and a test bench flow sensor.

FIG. 4 shows by way of example a pressure schematic that provides a quadratic relation between air mass flow and pressure drop. For example, a drop is dependent on air mass flow (g/s) and will increase quadratically with increasing flow. In this respect, in one form, the air filter (103) may be modelled as a restriction to the air intake flow. Assuming a one-dimensional incompressible and adiabatic flow, the depression before the compressor $p_1$ (202), can be described with a quadratic function of the mass flow:

$$\hat{p}_1 = p_0 - \frac{C_{af} T_0 W_{fresh}^2}{p_0} \quad \text{Eq. 12}$$

Here, $C_{af}$ is the air filter resistance, $p_0$ (201*a*) is the ambient air pressure, $T_0$ (201*b*) is the ambient air temperature, and $W_{fresh}$ (210) is the fresh air mass flow rate through the air filter. Given a certain flow resistance a quadratic relation between mass flow and pressure drop is typical, see FIG. 2. In further elaborations, additional modelling may be done without departing from the novel concept to provide a fresh air flow based on measuring in a previous time frame, before said actual time frame, a pressure drop over the air treatment device. One implementation may be to update the fresh air flow estimate $W_{fresh}$ (210) using the error calculated as a difference between the measured pre compressor pressure p1 (202) and the estimated pre-compressor pressure from the quadratic filter model, see Eq. (12). This leads to a calibratable gain $k_w$ i.e. by:

$$W_{fresh}^{i+1} = W_{fresh}^{i} - k_w \cdot (\hat{p}_1 - p_1) \quad \text{Eq. 13}$$

In the air filter model by Eq. (12), the air filter resistance (which only varies on longer time scales) can be computed by comparison from another measurement, e.g. by using a measurement of a specimen concentration, such as oxygen in the exhaust.

While the measurement of specimen concentrations in exhaust gas suffers from a considerable measurement delay and is unable to detect fast changes in the mass flow, it can however be used for calibration purposes of the fast detection carried out by the pressure sensors by adjusting parameter $C_{af}$ in Eq (12). More particular, the flow resistance of the air treatment device can be estimated by comparing an estimate of the oxygen content in the exhaust based on a stoichiometric air-fuel ratio constant and measured oxygen content of a number of time frames in the past from an oxygen sensor and a fuel mass flow sensor. The flow resistance of the air treatment device can be estimated based on the measured fuel mass flow, said measured oxygen content and a stoichiometric air-fuel ratio.

In one form this may be provided by a measurement of the oxygen concentration of the exhaust gas O2% 209. With knowledge of the fresh air mass flow $W_{fresh}$ 210 and fuel mass flow $W_{fresh}$ 205, the exhaust gas mass flow $W_{exh}$ 211 can be estimated.

For example: The oxygen concentration in the exhaust can be computed by:

$$\hat{O}_{2\%exh} = O_{2\%air} - \frac{O_{2\%air} \cdot L_{stoich} \cdot W_{fuel}}{W_{fresh}} \quad \text{Eq. 14}$$

In which $W_{fuel}$ (205) is the fuel mass flow, O2% air is the oxygen concentration of fresh air, and $L_{stoich}$ is the stoichiometric air-fuel ratio.

The air to fuel ratio is defined as:

$$\lambda = \frac{W_{fresh}}{L_{stoich} W_{fuel}} \quad \text{Eq. 15}$$

To compensate for the measurement delay of the O2% sensor, the estimated oxygen percentage in the exhaust is delayed with on integer number of samples of the sampling frequency.

$$\hat{O}_{2\%\ exh}^{delay}(k-N)=\hat{O}_{2\%\ exh}(k) \quad \text{Eq. 15}$$

Where k indicates the kth time step in a digital controller, and integer N indicates the number of time steps of delay, By comparing a delayed pressure drop of an air treatment device with the outcome of the fresh air mass flow from a slow oxygen measurement, a calibration can be given to the base of the differential equation (7) that provides a time resolved incremental change to the fresh air mass flow. One implementation may be to update the fresh air flow estimate $W_{fresh}$ (210) using the error calculated as a difference between the measured pre compressor pressure p1 (202) and the estimated pre-compressor pressure from the quadratic filter model. This leads to a calibratable gain $k_w$ i.e. by:

$$W_{fresh}^{i+1}=W_{fresh}^{i}-k_w\cdot(\hat{p}_1-p_1) \quad \text{Eq. 17}$$

One implementation may be to update the air filter (103) resistance $C_{af}$ of the quadratic filter model using a calibratable gain $k_{O2}$ of an error between the measured and estimated oxygen concentration; i.e. by:

$$C_{af}^{i+1}=C_{af}^{i}-k_{O2}\cdot(\hat{O}_{2\%\ exh}-O_{2\%\ exh}) \quad \text{Eq. 18}$$

Figure 5:
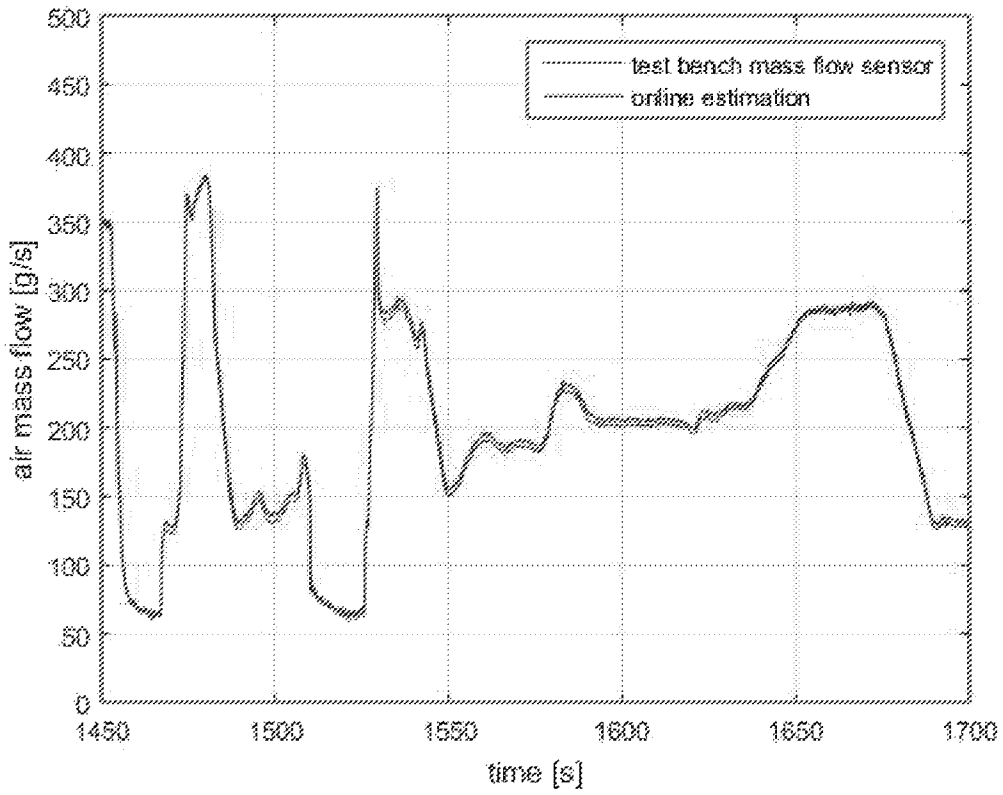
Figure 6:
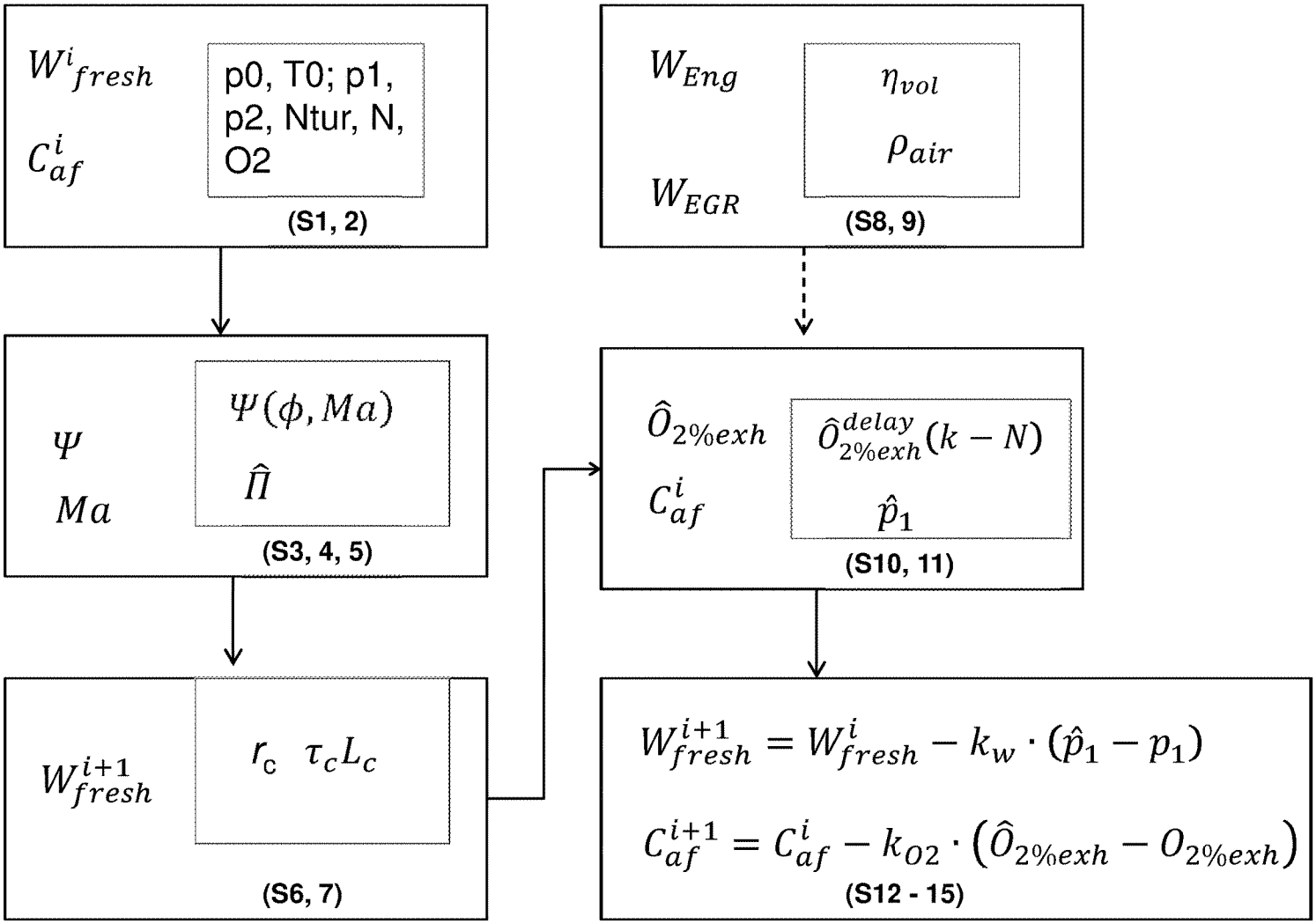

Thus, by combining the fast and slow measurements in an iterative way, from the fast pressure drop inputs, an estimated actual fresh air flow can be derived, that is updated iteratively while calibrating it with the slower measurement. FIG. 5 shows a sample measurement of the actual measured fresh flow and the estimated fresh air flow, the steps S1-15 as detailed in FIG. 6.

Step 0. Initialize by providing an initial value of the fresh air mass flow, delayed oxygen concentration of the exhaust gas and air filter resistance $C_d$.

Iterate the Following Steps

Step 1. Obtain $W_{fresh}$ (210), and filter resistance Caf from previous iteration, or from step 0 during the first iteration.

Step 2. measurements of p0 (201*a*), T0 (201*b*), p1 (202), p2 (203), ntur (204), n (206) and O2% (209) are received by the controller (100).

Step 3. Compute the normalized air flow and blade Mach number using Eq. (4) to (8)

Step 4. Obtain the energy transfer coefficient from the lookup table displayed in FIG. 1.

Step 5. Solve the pressure ratio from Eq. (9) using the energy transfer coefficient from step 4.

Step 6. Compute the right hand side of differential equation (10) using the pressure ratio from step 5.

Step 7. Apply numerical integration to solve the differential equation (10) (in the first iteration of this scheme the initial guess from Step 0 is used)

Step 8. Obtain an estimate of the engine mass flow $W_{eng}$ (207) using the speed density method Eq (1) to (3)

Step 9. Compute the EGR mass flow $W_{egr}$ (208) using the engine mass flow $W_{eng}$ (207) from step 8 and the fresh air mass flow $W_{fresh}$ (210) from step 7.

Step 10. Compute the pre-compressor pressure using the fresh air mass flow $W_{fresh}$ (210) from Step 7 and the air filter resistance Caf from step 1 (in the first iteration of this scheme the initial guess from Step 0 is used.) with Eq. (12)

Step 11. Compute the oxygen concentration in the exhaust Eq. (13) and the delayed oxygen concentration Eq. (15) (during the first N iterations of this scheme the initial)

Step 12. Compute the difference between the measured pre compressor pressure p1 (202) and the estimated pre-compressor pressure from Step 10.

Step 13. Compute the difference between the measured O2% (209) and the estimated exhaust gas oxygen concentration from Step 11.

Step 14. Update the fresh air flow estimate $W_{fresh}$ (210) using the error from Step 12 and a calibratable gain $k_w$ i.e. by:

$$W_{fresh}^{i+1}=W_{fresh}^{i}-k_w\cdot(\hat{p}_1-p_1) \quad \text{Eq. 18}$$

Step 15. Update the air filter (103) resistance $C_a$r using the error from Step 13 and a calibratable gain $k_{O2}$ i.e. by:

$$C_{af}^{i+1}=C_{af}^{i}-k_{O2}\cdot(\hat{O}_{2\%\ exh}-O_{2\%\ exh}) \quad \text{Eq. 19}$$

Return to Step 1 of the Iteration

It is thus believed that the operation and construction of the present invention will be apparent from the foregoing description and drawings appended thereto. For the purpose of clarity and a concise description, features are described herein as part of the same or separate embodiments, however, it will be appreciated that the scope of the invention may include embodiments having combinations of all or some of the features described. It will be clear to the skilled person that the invention is not limited to any embodiment herein described and that modifications are possible which may be considered within the scope of the appended claims. Also kinematic inversions are considered inherently disclosed and can be within the scope of the invention. In the claims, any reference signs shall not be construed as limiting the claim. The terms 'comprising' and 'including' when used in this description or the appended claims should not be construed in an exclusive or exhaustive sense but rather in an inclusive sense. Thus expression as 'including' or 'comprising' as used herein does not exclude the presence of other elements, additional structure or additional acts or steps in addition to those listed. Furthermore, the words 'a' and 'an' shall not be construed as limited to 'only one', but instead are used to mean 'at least one', and do not exclude a plurality. Features that are not specifically or explicitly described or claimed may additionally be included in the structure of the invention without departing from its scope. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. To the extend that structure, material, or acts are considered to be essential they are inexpressively indicated as such. Additions, deletions, and modifications within the purview of the skilled person may generally be made without departing from the scope of the invention, as determined by the claims.

The invention claimed is:

1. A system for estimating fresh air mass flow into a turbocharged engine comprising:

a compressor located in an inlet flow path of the engine and at least a pressure sensor in an inlet of the compressor and a pressure sensor in an outlet of the compressor;

an air treatment device located in the flow path of the engine; at least a pressure sensor in an inlet of the air treatment device and a pressure sensor in an outlet of the air treatment device;

a controller arranged to determine an actual fresh air mass flow in subsequent time frames by measuring, in an actual time frame, a pressure drop over the compressor and using a first calculated fresh air mass flow as a starting value for deriving a second fresh air mass flow in said time frame from a compressor model using the measured pressure drop and compressor rotational speed; and measuring in a previous time frame, before said actual time frame, a pressure drop over the air treatment device;

estimating a pressure drop over the air treatment device using the second fresh air mass flow and an estimated flow resistance of the air treatment device;

correcting the second fresh air mass flow by comparing the estimated pressure drop with the measured pressure drop over the air treatment device and using the corrected second fresh air mass flow as an actual fresh airmass mass flow in said time frame, and using the actual fresh air flow in said time frame as first calculated fresh air mass flow in a next time frame of a subsequent iteration.

2. The system according to claim 1, wherein said flow resistance of the air treatment device is estimated from a sensor having a time delay larger than the time frame.

3. The system according to claim 2, wherein the flow resistance of the air treatment device is estimated by comparing the actual fresh air mass flow of a number of time frames in the past with the measured air mass flow from a flow sensor.

4. The system according to claim 2, wherein the flow resistance of the air treatment device is estimated by comparing an estimate of the oxygen content in the exhaust based on the actual fresh air mass flow of a number of time frames in the past, the measured fuel mass flow, and measured oxygen content from an oxygen sensor.

5. The system according to claim 1, wherein the air treatment device is an air filter, turbo cooler or other after treatment device.

6. The system according to claim 1, wherein the turbocharged engine is a diesel engine, and wherein an exhaust gas recirculation device is arranged in parallel to the diesel engine and the outlet of the compressor, wherein a mass flow through the exhaust gas recirculation device is calculated as the difference between the fresh air mass flow and the mass flow through the diesel engine.

7. The system according to claim 6, wherein the mass flow through the diesel engine is calculated from a speed density model.

8. A method for estimating fresh air mass flow into a turbocharged engine wherein a compressor is located in an inlet flow path of the engine and at least a pressure sensor is located in an inlet of the compressor and a pressure sensor in an outlet of the compressor; wherein an air treatment device is located in the flow path of the engine; and at least a pressure sensor is located in an inlet of the air treatment device and a pressure sensor is located in an outlet of the air treatment device; the method comprising:

measuring, in an actual time frame, a pressure drop over the compressor;

using a first calculated fresh air mass flow as a starting value for deriving a second fresh air mass flow in said time frame from a compressor model using the measured pressure drop and a compressor rotational speed;

measuring in a previous time frame, before said actual time frame, a pressure drop over the air treatment device;

estimating a pressure drop over the air treatment device using the second fresh air mass flow and an estimated flow resistance of the air treatment device;

correcting the second fresh air mass flow by comparing the estimated pressure drop with the measured pressure drop over the air treatment device and using the corrected second fresh air mass flow as an actual fresh air mass flow in said time frame, and using the actual fresh air mass flow in said time frame as first calculated fresh air mass flow in a next time frame of a subsequent iteration.

* * * * *